US007591261B2

(12) United States Patent
Wei

(10) Patent No.: US 7,591,261 B2
(45) Date of Patent: Sep. 22, 2009

(54) AIR CYLINDER MOUNTING STRUCTURE FOR AIR GUN

(76) Inventor: Wilson Wei, P.O. Box 24-108, Taipei (TW)

( * ) Notice: Subject to any disclaimer, the term of this patent is extended or adjusted under 35 U.S.C. 154(b) by 443 days.

(21) Appl. No.: 11/653,459

(22) Filed: Jan. 16, 2007

(65) Prior Publication Data

US 2008/0168972 A1 Jul. 17, 2008

(51) Int. Cl.
*F41B 11/00* (2006.01)

(52) U.S. Cl. ..... 124/74; 124/45; 124/80

(58) Field of Classification Search ..... 124/45, 124/74, 80

See application file for complete search history.

(56) References Cited

U.S. PATENT DOCUMENTS

| | | | | | |
|---|---|---|---|---|---|
| 2,940,438 | A * | 6/1960 | Merz | 124/76 |
| 3,204,625 | A * | 9/1965 | Shepherd | 124/74 |
| 3,207,143 | A * | 9/1965 | Kline et al. | 124/76 |
| 3,527,194 | A * | 9/1970 | Desrochers et al. | 124/76 |
| RE27,568 | E * | 1/1973 | Vadas | 124/76 |
| 3,824,981 | A * | 7/1974 | Crane et al. | 124/76 |
| 5,160,795 | A * | 11/1992 | Milliman | 42/65 |
| 5,165,383 | A * | 11/1992 | Ebert et al. | 124/74 |
| 5,400,536 | A * | 3/1995 | Milliman | 42/65 |
| 5,404,863 | A * | 4/1995 | Poor | 124/74 |
| 5,704,150 | A * | 1/1998 | Milliman | 42/67 |
| 5,711,286 | A * | 1/1998 | Petrosyan et al. | 124/73 |
| 5,906,191 | A * | 5/1999 | Wonisch et al. | 124/31 |
| 6,026,797 | A * | 2/2000 | Maeda et al. | 124/74 |
| 6,029,645 | A * | 2/2000 | Wonisch et al. | 124/74 |
| 6,494,194 | B2 * | 12/2002 | Shipachev et al. | 124/73 |
| 6,578,565 | B2 * | 6/2003 | Casas Salva | 124/73 |
| 6,869,285 | B1 * | 3/2005 | Jones, II | 434/16 |
| 7,237,543 | B2 * | 7/2007 | Su | 124/71 |
| RE39,805 | E * | 9/2007 | Maeda et al. | 124/74 |
| 7,353,815 | B2 * | 4/2008 | Wei | 124/45 |
| 7,398,776 | B2 * | 7/2008 | Casa Salva | 124/74 |
| 7,478,632 | B2 * | 1/2009 | Halmone | 124/74 |
| 2007/0181116 | A1 * | 8/2007 | Wei | 124/74 |
| 2007/0235014 | A1 * | 10/2007 | Tiberius et al. | 124/52 |
| 2008/0060630 | A1 * | 3/2008 | Halmone | 124/73 |
| 2008/0141991 | A1 * | 6/2008 | Liu | 124/56 |
| 2008/0168974 | A1 * | 7/2008 | Kaminker et al. | 124/74 |

* cited by examiner

*Primary Examiner*—Troy Chambers

(57) ABSTRACT

An air cylinder mounting structure for air gun is disclosed to include a rack mounted in the grip of an air gun to accommodate a high pressure air cylinder in connection with a bullet supplying and firing system of the air gun, a stop member mounted in the rack at the bottom side, a biasable member mounted inside the rack and supported on the stop member; a hand screw type push member fastened to the biasable member for supporting a high pressure cylinder in the rack in connection with the bullet supplying and firing system of the air gun, an anti-skip disk mounted on the threaded shank of push member, and a spring member mounted on the threaded shank of the hand screw type push member and stopped between the biasable member and the anti-skip disk.

4 Claims, 6 Drawing Sheets

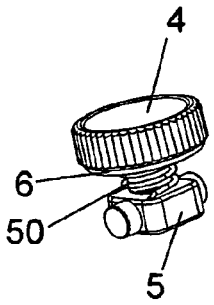
FIG.3
FIG.4
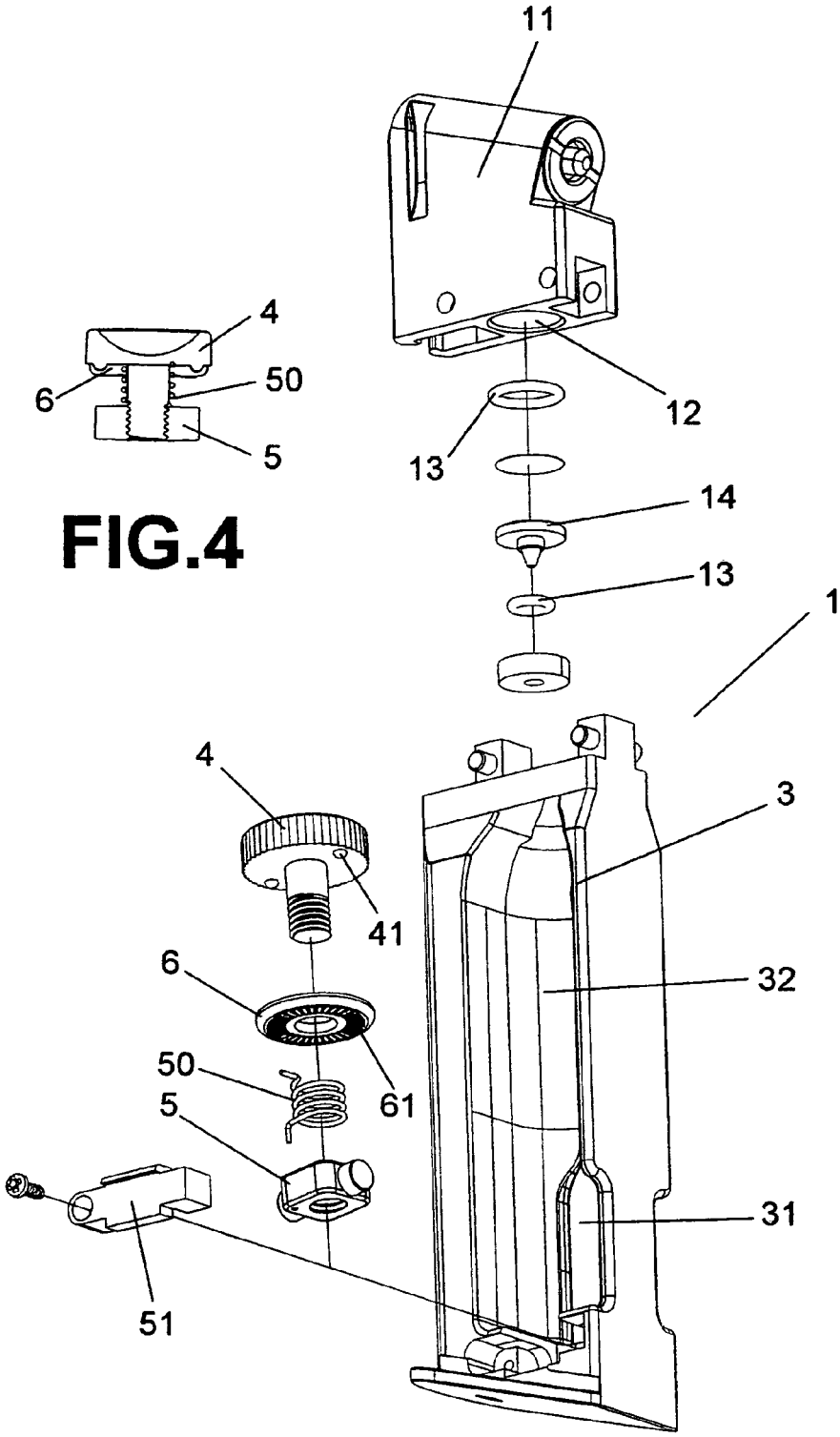
FIG.2

AIR CYLINDER MOUNTING STRUCTURE FOR AIR GUN

BACKGROUND OF THE INVENTION

1. Field of the Invention

The present invention relates an air gun for shooting a BB bullet or paint bullet by a compressed gas from an air cylinder and more particularly, to an air cylinder mounting structure for such an air gun, which uses a biasable member to support a push member for quick loading of a high pressure air cylinder in a rack in engagement with a pin in the air valve of the bullet supplying and firing system of the air gun, and a spring member to impart a pressure to the push member against the loaded high pressure air cylinder, assuring positive positioning of the loaded high pressure air cylinder.

2. Description of the Related Art

A gun is a weapon used in martial arts. Nowadays, various kinds of guns are used for exercises and competitions. For example, BB gun and pain gun are intensively used for exercises. A BB gun or pain gun uses a high pressure air cylinder to provide a compressed gas for driving out BB bullet or paint bullet toward the target. A BB gun or pain gun generally provides an accommodation chamber for accommodating a high pressure air cylinder. The accommodation chamber has a cap fastened to the bottom side with screws to hold a spring member and a pressure board on the spring member. Before loading of a high pressure air cylinder, the user must remove the screws to detach the cap from the accommodation chamber. After loading of a high pressure air cylinder in the accommodation chamber, the user must close the cap on the accommodation chamber and then install the screws again to affix the cap to the accommodation chamber. This high pressure air cylinder loading and unloading procedure is complicated. Further, the cap is provided with an adjustment screw at the bottom side for adjusting the spring power of the spring member. However, because the adjustment screw protrudes over the bottom side of the grip of the air gun, it obstructs the sense of beauty of the air gun, and may cause potential injury to the user.

SUMMARY OF THE INVENTION

The present invention has been accomplished under the circumstances in view. It is the main object of the present invention to provide an air cylinder mounting structure for air gun, which allows quick loading and unloading of a high pressure air cylinder. It is another object of the present invention to provide an air cylinder mounting structure for air gun, which assures positive positioning of the loaded high pressure air gun.

To achieve these and other objects of the present invention, the air cylinder mounting structure is installed in a magazine for air gun or the grip of an air gun and adapted to hold a high pressure air cylinder in engagement with a pin in an air valve inside the air gun, comprising a rack, a stop member, a biasable member, a push member, an anti-skip disk, and a spring member. The rack is mounted inside the grip of the air gun and adapted to accommodate a high pressure air cylinder in connection with a bullet supplying and firing system of the air gun. The rack has a left finger hole and a right finger hole. The stop member is mounted in the rack at the bottom side. The biasable member is mounted inside the rack and supported on the stop member. The push member is fastened to the biasable member and adapted to support a high pressure air cylinder in the rack in connection with the bullet supplying and firing system of the air gun. The push member has a head, and a threaded shank perpendicularly extending from the head and threaded into the biasable member. The anti-skip disk is mounted on the threaded shank of the push member, having a toothed portion formed on the bottom side. The spring member is mounted on the threaded shank of the push member and stopped between the biasable member and the anti-skip disk. The spring member has a top end engaged with the toothed portion of the anti-skip disk and a bottom end fastened to the biasable member.

Through the left finger hole and right finger hole, the user can insert fingers into the rack to rotate the push member and to further adjust the spring power of the spring member.

Further, the head of the push member has a plurality of raised portions protruded from the bottom wall, and the anti-skip disk has a plurality of recesses formed on the top side and forced into engagement with the raised portions of the push member to assure positive transmission of spring power from the spring member to the push member against the loaded high pressure air cylinder.

BRIEF DESCRIPTION OF THE DRAWINGS

FIG. 2 is an exploded view of the air cylinder mounting structure according to the present invention.

FIG. 3 is an elevational assembly view of a part of the air cylinder mounting structure according to the present invention.

FIG. 4 is a sectional side view of FIG. 3.

DETAILED DESCRIPTION OF THE INVENTION

Figure 1:
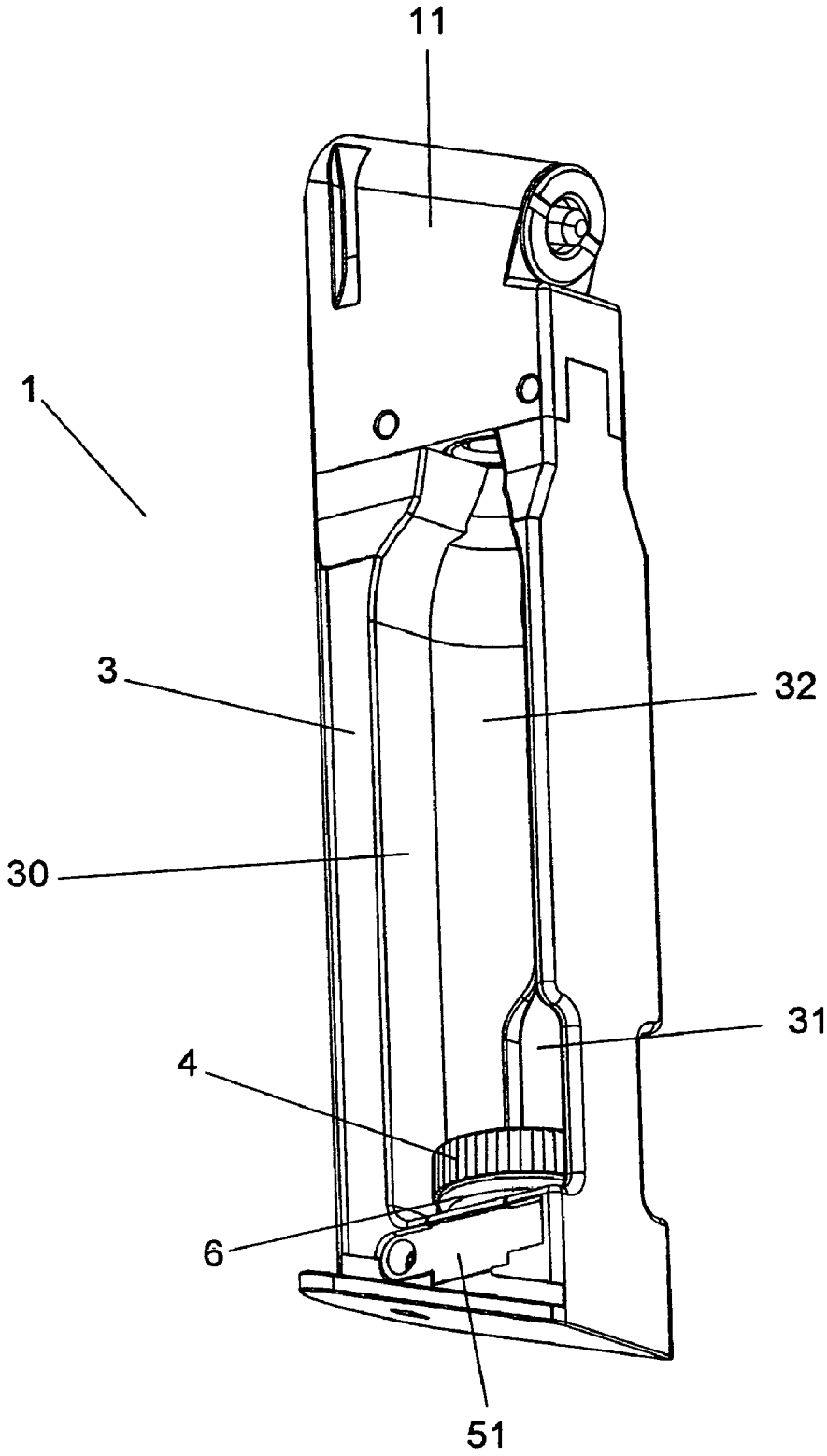
FIG. 1 is an elevational assembly view of an air cylinder mounting structure after loading of a high pressure air cylinder according to the present invention.
Figure 5:
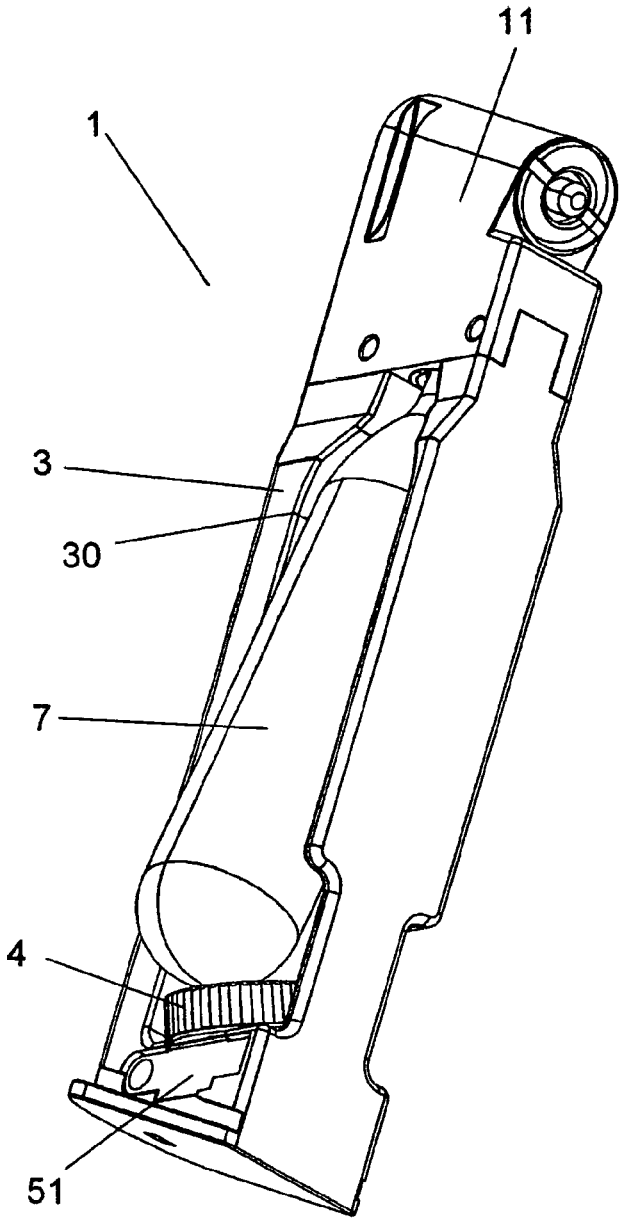
FIG. 5 is a schematic drawing showing the installation of a high pressure air cylinder in the rack of the air cylinder mounting structure according to the present invention.
Figure 7:
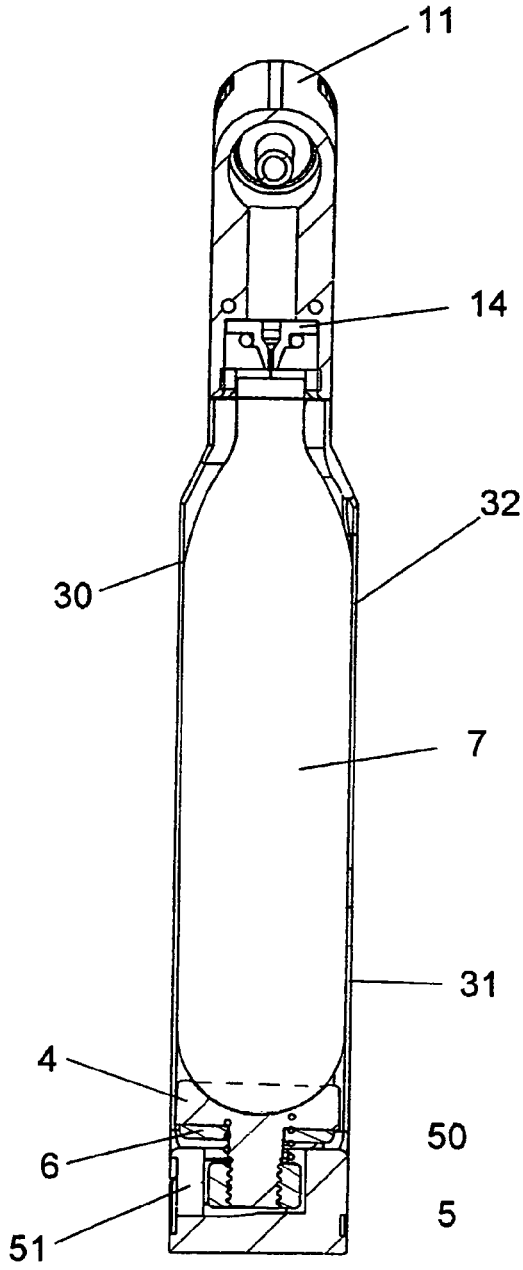
FIG. 7 is a sectional side view showing a high pressure air cylinder positioned in the rack of the air cylinder mounting structure according to the present invention.
Figure 6:
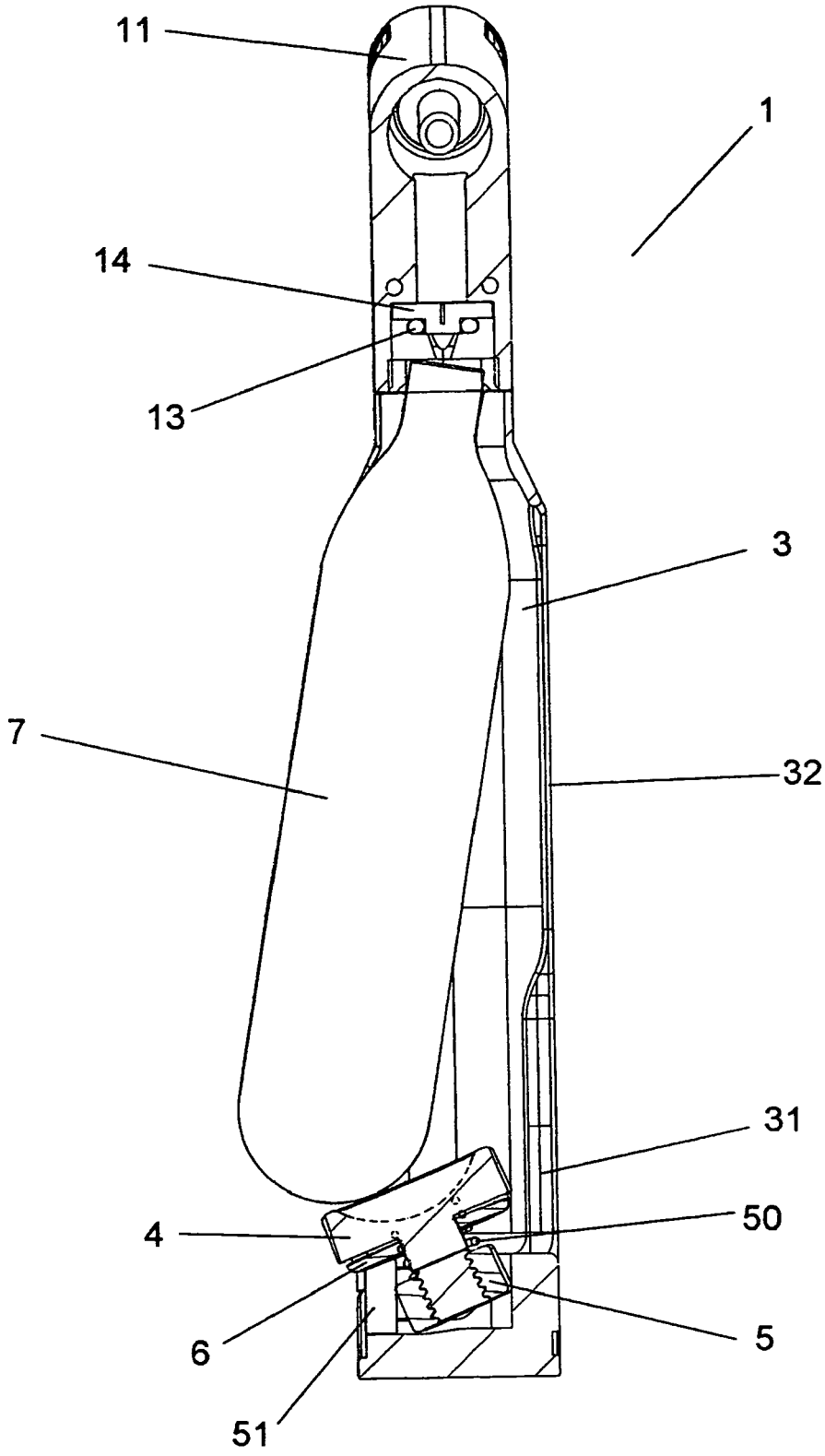
FIG. 6 is a sectional side view of FIG. 5.
Figure 8:
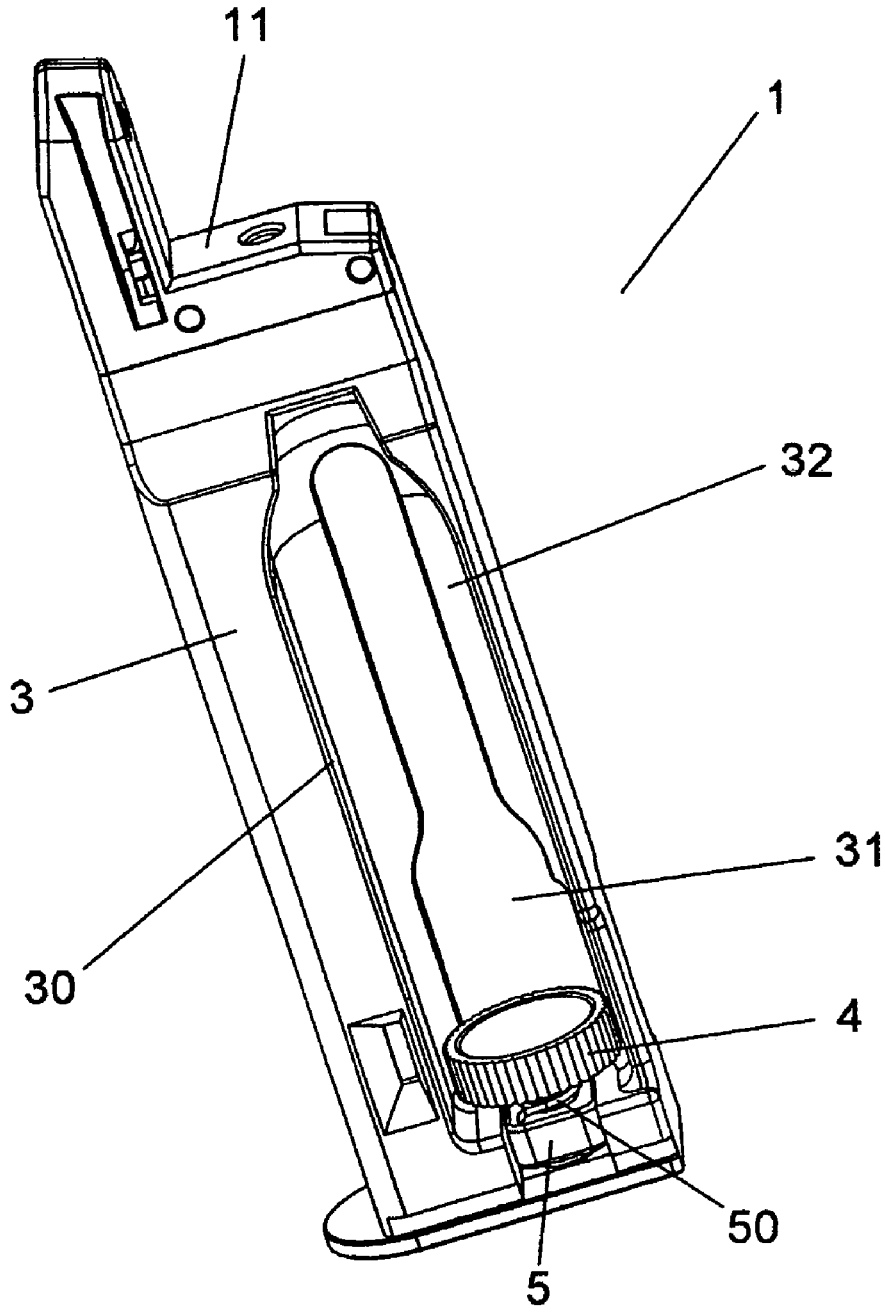
FIG. 8 is a schematic drawing showing the present invention before loading of a high pressure air cylinder.
Figure 9:
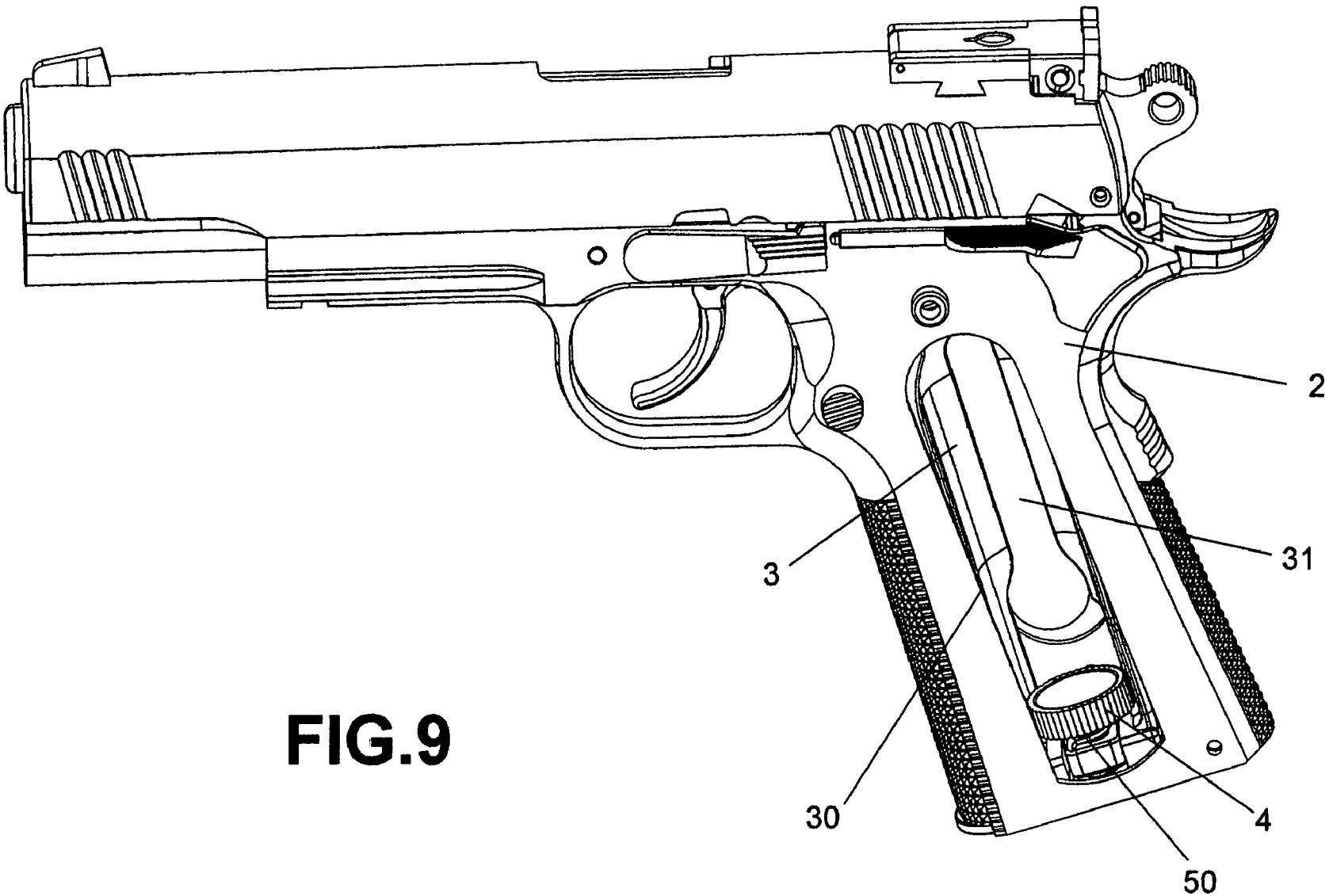
FIG. 9 is a schematic drawing showing the air cylinder mounting structure installed in an air gun according to the present invention.

Referring to the annexed drawings in detail, an air cylinder mounting structure in accordance with the invention can be installed in a magazine 1 for air gun or the grip 2 of an air gun and coupled to the bullet supplying and firing system of the air gun. The air cylinder mounting structure is comprised of a rack 3, a push member 4, a biasable member 5, a spring member 50, and an anti-skip disk 6.

The rack 3 is adapted to accommodate a high-pressure air cylinder 7, having a left finger hole 30 and a right finger hole 31. A stop member 51 is mounted in the bottom side of the rack 3 to support a biasable member 5. The push member 4 is shaped like a hand screw and threaded into the biasable member 5, having a plurality of raised portions 41 protruded from the bottom side of the hand thereof. The anti-skip disk 6 is mounted on the threaded shank of the push member 4, having a plurality of recesses (not shown) formed on the top side and respectively forced into engagement with the raised portions 41 of the push member 4 to prohibit rotation of the anti-skip disk 6 relative to the push member 4 and a toothed portion 61 on the bottom side for securing the spring member 50. The spring member 50 is sleeved onto the threaded shank of the push member 4 and stopped between the biasable member 5 and the anti-skip disk 6, having a top end engaged with the toothed portion 61 of the anti-skip disk 6 and a bottom end fastened to the biasable member 5. Further, an air valve 11 is mounted on the top side of the rack 3 and connected to a compressed gas supply tube inside the air gun, having a bottom air hole 12 mounted with a pin 14 and two rubber gasket rings 13. The two rubber gasket rings 13 are mounted in the bottom air hole 12 of the air valve 11 at top and bottom sides of the pin 14. For safety's sake, the rack 3 allows loading of a high-pressure air cylinder 7 from one side only, i.e., from the front side. Through the finger holes 30 and 31, the user can insert the fingers into the rack 3 to rotate the push member 4, thereby adjusting the spring power of the spring member 50.

When in use, insert one finger into the right finger hole 31 to push the push member 4 toward the left finger hole 30 and to simultaneously force the biasable member 5 to bias toward the outside of the rack 3, and then insert the high-pressure air cylinder 7 into the rack 3 to position the bottom wall of the high-pressure air cylinder 7 in the inwardly curved top wall of the push member 4, and then push the air cylinder 7 inwards toward the inside of the rack for enabling the top air valve (not shown) of the air cylinder 7 to be forced into engagement with the pin 14. At this time, the pin 14 opens the top air valve of the air cylinder 7, for allowing compressed gas to flow out of the air cylinder 7 into the air valve 11 for driving BB bullets out of the air gun subject to the control of the bullet supplying and firing system of the air gun. When dismounting the air cylinder 7, reverse the aforesaid procedure. Further, the user can insert the fingers into the finger holes 30 and 31 to rotate the push member 4, thereby adjusting the spring power of the spring member 50. Therefore, the invention allows fine adjustment of the pressure to the loaded air cylinder 7 against the pin 13 in the air valve 11.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An air cylinder mounting structure installed in a grip of an air gun and adapted to hold a high pressure air cylinder in engagement with a pin in an air hole into the air gun, comprising:

a rack mounted inside the grip of the air gun and adapted to accommodate a high pressure air cylinder in connection with a bullet supplying and firing system of the air gun, said rack having a left finger hole and a right finger hole;

a stop member mounted in said rack at a bottom side;

a biasable member mounted inside said rack and supported on said stop member;

a push member fastened to said biasable member and adapted to support a high pressure air cylinder in said rack in connection with the bullet supplying and firing system of the air gun, said push member having a head and a threaded shank perpendicularly extending from said head and threaded into said biasable member, the head of said push member having a plurality of raised portions protruded from a bottom wall thereof;

an anti-skip disk mounted on the threaded shank of said push member, said anti-skip disk having a plurality of recesses formed on a top side thereof and forced into engagement with the raised portions of said push member and a toothed portion formed on a bottom side thereof; and a spring member mounted on said push member and stopped between said biasable member and said anti-skip disk, said spring member having a top end engaged with the toothed portion of said anti-skip disk and a bottom end fastened to said biasable member.

2. The air cylinder mounting structure as claimed in claim 1, wherein said rack is installed in a magazine for bullet that is mountable in the grip of the air gun.

3. The air cylinder mounting structure as claimed in claim 1, wherein said pin is mounted in between two rubber rings in said air hole of said air valve.

4. The air cylinder mounting structure as claimed in claim 1, wherein said rack has one single open side for the loading of a high pressure air cylinder.

* * * * *